US005938968A

United States Patent [19]

Ogg et al.

[11] Patent Number: 5,938,968

[45] Date of Patent: Aug. 17, 1999

[54] RETRACTABLE SHELF ASSEMBLY FOR A MICROWAVE OVEN

[76] Inventors: Starla Ogg, 626 N. Sycamore; Paul Ogg, 626 N. Sycamore, both of Gardner, Kans. 66030

[21] Appl. No.: 08/921,981

[22] Filed: Aug. 28, 1997

[51] Int. Cl.[6] ..... H05B 6/80

[52] U.S. Cl. ..... 219/763; 219/732; 219/756; 126/339

[58] Field of Search ..... 219/763, 762, 219/756, 732; 126/339, 340; 312/236

[56] References Cited

U.S. PATENT DOCUMENTS

| | | | |
|---|---|---|---|
| 434,970 | 8/1890 | Allyn | 126/339 |
| 1,832,729 | 11/1931 | Ohnstrand | 126/339 |
| 2,809,086 | 10/1957 | Fall | 126/340 |
| 4,335,292 | 6/1982 | Tanaka et al. | 219/763 |
| 4,511,779 | 4/1985 | Bucksbaum et al. | 219/732 |
| 4,539,455 | 9/1985 | Colato et al. | 219/732 |
| 4,705,929 | 11/1987 | Atkinson | 219/732 |
| 4,759,341 | 7/1988 | McFarland | 126/339 |
| 4,814,571 | 3/1989 | Bowen et al. | 219/763 |
| 4,954,680 | 9/1990 | Takenouchi | 219/763 |
| 5,338,922 | 8/1994 | Kim et al. | 219/763 |
| 5,436,434 | 7/1995 | Baird | 219/734 |

*Primary Examiner*—Philip H. Leung
*Attorney, Agent, or Firm*—Kenneth L. Tolar

[57] ABSTRACT

The present invention relates to a retractable shelf assembly which may be easily mounted within a microwave oven cooking chamber. A pair of elongated substantially rectangular outer track members having an open end are mounted to the bottom of the microwave oven interior adjacent opposing sides. A pair of inner track members are longitudinally and slidably received within the outer track members and telescopable therefrom. A shelf with a pair of open sided channels on opposing edges is attached at an end to the inner track members and slidably engages the outer track members. The telescoping track and channel assembly allows the shelf to be slid horizontally into or out of a microwave oven as desired. A telescoping brace component vertically extends from the upper surface of the shelf component to engage the interior of the microwave thereby preventing the tray from completely sliding off the telescoping track mechanism. The shelf has a recessed area that defines an integral handle and a telescoping handle horizontally extending from an edge of the shelf member which may be used in the event the recessed handle is inaccessible.

17 Claims, 2 Drawing Sheets

RETRACTABLE SHELF ASSEMBLY FOR A MICROWAVE OVEN

BACKGROUND OF THE INVENTION

Shelves and support stands have traditionally been used for suspending food items in a microwave oven to promote cooking efficiency. Although cooking foods in a microwave oven is usually much quicker than conventional cooking, it still requires intermittent stirring and rotating of the food or possibly adding additional ingredients thereto during the cooking process. Because a microwave oven interior is generally small and deep, reaching into the microwave cooking chamber to stir food resting on a shelf can be cumbersome and awkward since very little vertical space is available between the food and the oven ceiling.

The present invention relates to a shelf slidably mounted to a telescoping track assembly which may be easily attached to the interior of the microwave oven. Accordingly, the shelf may be withdrawn from a microwave oven interior in a drawer like fashion to overcome the problems mentioned above. In addition, the device offers numerous advantages over the horizontally sliding metal rod support trays typically found in conventional thermal ovens in which two sides of the tray are received within integral grooves on opposing sides of the oven. The present invention including the slide track mechanism is removably attached to the microwave oven interior allowing a single assembly to be interchangeably used with an unlimited number of microwave ovens. Furthermore, the present invention allows the shelf to be slid completely out of the cooking chamber while being rigidly supported underneath by the telescoping track mechanism.

DESCRIPTION OF THE PRIOR ART

Numerous devices exist in the prior art which aid a user when cooking foods in a microwave. Several of these devices relate to shelves or support stands mountable within the interior of a microwave oven. However, none of these devices relate to a shelf mounted on a removably attached telescoping track assembly allowing the shelf to be slid horizontally from the oven interior. U.S. Pat. No. 5,436,434 issued to Baird discloses a splatter guard for a microwave oven designed to cover open containers of food. The cover also has a plurality of vertically aligned tabs which define slots for receiving the splatter guard so that the device may be raised or lowered to a desired height.

U.S. Pat. No. 4,705,929 issued to Atkinson relates to a heating stand for supporting an item in a microwave oven. The tray includes a support wall and four perimetric walls hingedly attached thereto which can be erected to form legs. The heating stand also has an interactive layer on its upper face.

U.S. Pat. No. 4,539,455 issued to Colato et al relates to an adjustable shelf for supporting food items in a microwave oven. The shelf has foldable legs which may be folded into a first position to be used in conjunction with a microwave turntable. Alternatively, the legs may be folded into a vertically extended position allowing the tray to stand so that foods may be cooked on the tray or underneath as desired.

U.S. Pat. No. 4,511,779 issued to Bucksbaum et al discloses a microwave oven rack fabricated from metal rods and having a glass or ceramic plate centrally mounted thereto. The rack is designed to promote heating and cooking efficiency. As indicated above, none of the prior art microwave oven shelves or racks disclose means for mounting the rack onto a removably attached telescoping track assembly allowing the shelf to be horizontally withdrawn from the oven interior.

SUMMARY OF THE INVENTION

The present invention relates to a shelf for mounting to the interior of a microwave oven which can be easily slid into or out of the microwave in a drawer like fashion. The device comprises a pair of oppositely disposed telescoping track mechanisms each mounted to the bottom of a microwave oven cooking chamber adjacent its side walls. Each of the track mechanisms comprises a hollow outer track member which telescopingly receives an inner track member. The outer track member has a plurality of apertures for receiving suction cups allowing the tracks to be easily and removably attached to the microwave interior. A substantially square shelf component having channels on two opposing sides are attached to the inner track members and slidably engage the outer track member allowing it to be easily slid into or out of the oven interior. A telescoping brace vertically extends from the upper surface of the shelf component for engaging the microwave interior to prevent the shelf and the attached inner track members from completely disengaging the outer track members. An edge of the shelf component has a recessed area which defines an integral handle to allow the shelf to be easily grasped by a user. In addition, a telescoping handle extends horizontally from an edge of the tray component in the event that the recessed handle is inaccessible or obstructed by hot food items.

It is therefore an object of the present invention to provide a microwave oven shelf that can be withdrawn horizontally from the oven interior.

It is yet another object of the present invention to provide a microwave oven shelf which facilitates stirring, rotating or adding ingredients to foods being cooked therein.

It is yet another object of the present invention to provide a microwave oven shelf slidably engaging a track mechanism that may be removably attached to a microwave oven interior.

It is yet another object of the present invention to provide a microwave oven shelf assembly that can be interchangeably used with a number of different microwave ovens.

It is yet another object of the present invention to provide a microwave oven shelf having means for preventing the tray from sliding off the track mechanism.

It is yet another object of the present invention to provide a microwave oven shelf having a telescoping handle. Other objects, features and advantages of the present invention will be readily apparent to those skilled in the art from the following detailed description of the preferred embodiment when considered with the attached drawings and the appended claims.

DESCRIPTION OF THE PREFERRED EMBODIMENT

Figure 1:
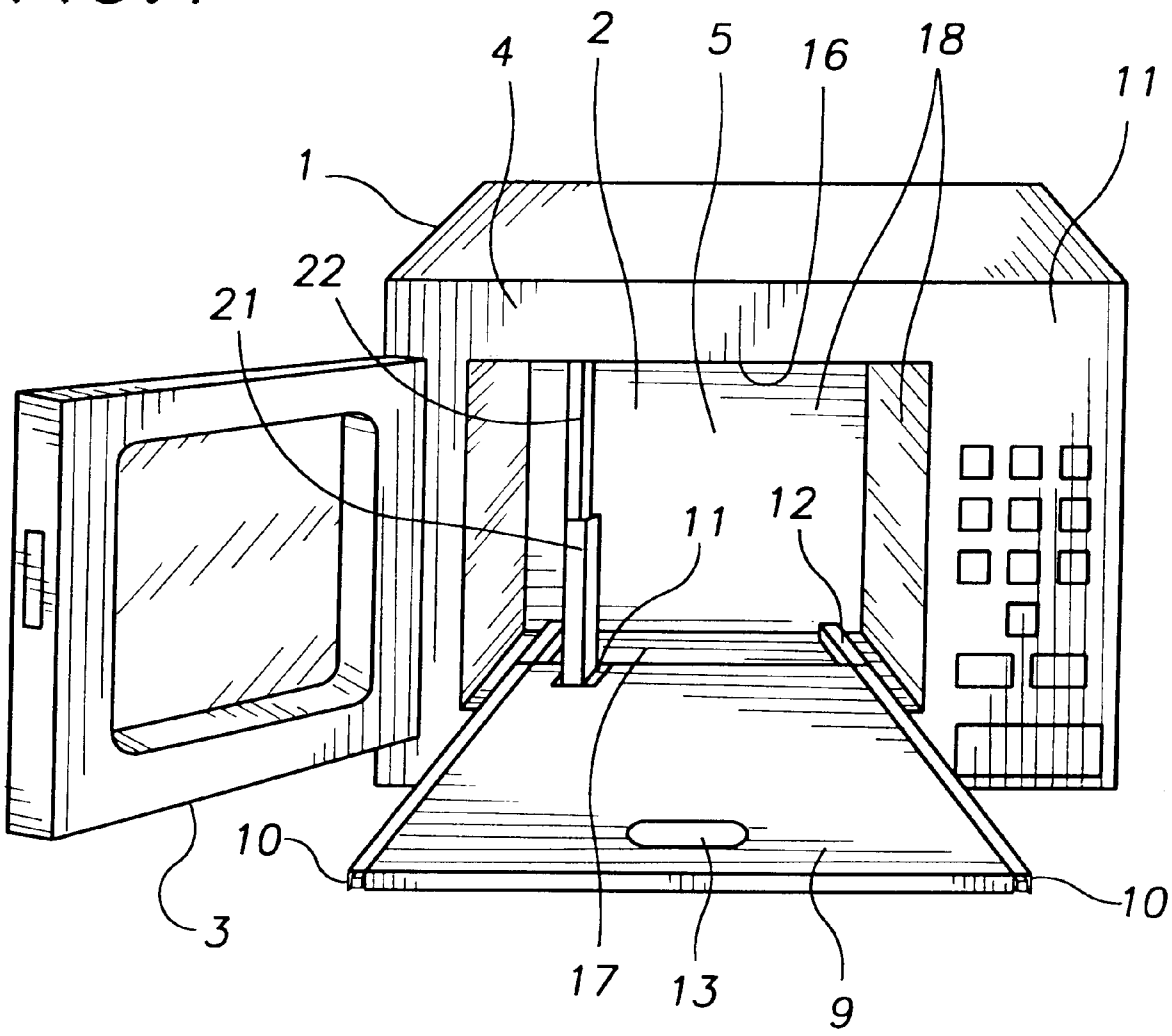
FIG. 1 depicts the inventive device with the shelf fully extended from the microwave oven interior.
Figure 2:
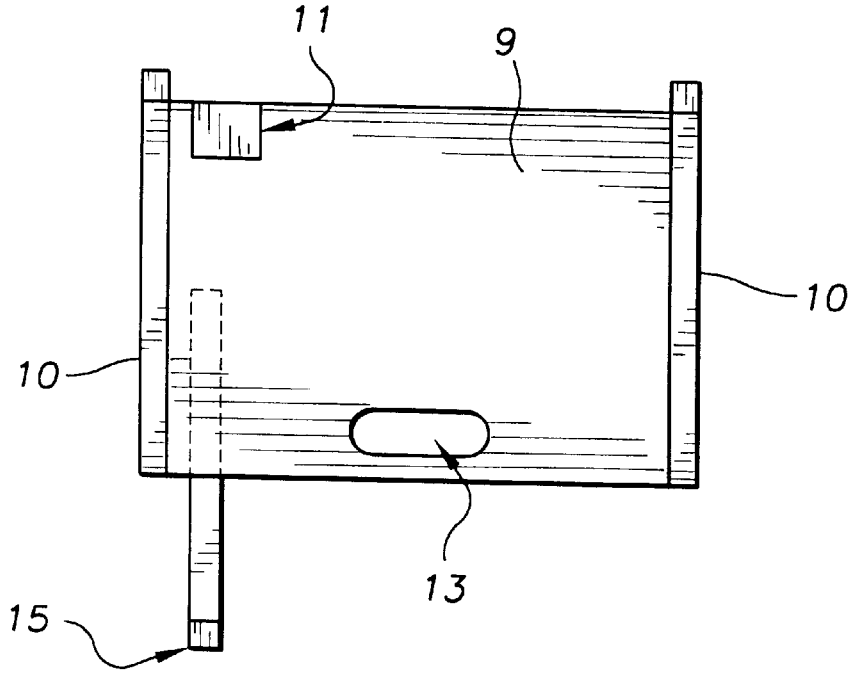
FIG. 2 is a bottom view of the shelf member and the slidingly engaging track mechanism.
Figure 3:
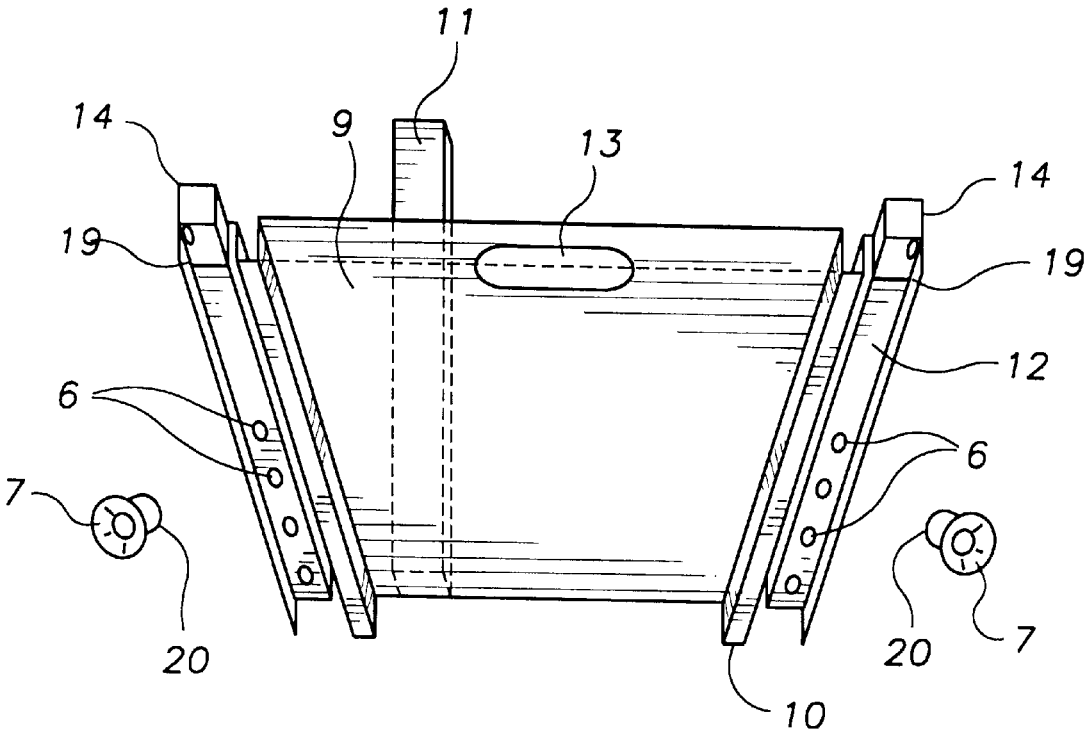
FIG. 3 is a top view of the track and shelf with the telescoping handle extending from an edge thereof.

Referring now to FIGS. 1 through 3, the present invention relates to a shelf assembly to be used in conjunction with a microwave oven. The microwave oven is of the type generally known in the prior art and comprises a hollow, substantially box shaped base component 1 having a top wall 16 and bottom wall 17 and three interior side walls 18 therebetween, the area between which defines a cooking chamber 5. On a side of the base component 1 is a rectangular opening 2 selectively enclosable with a door 3. Between the top horizontal border of the opening and the top wall is a vertically depending portion 4.

The present invention relates to a shelf assembly removably mounted within a microwave oven cooking chamber 5. The device comprises a pair of telescoping track mechanisms each mounted to the bottom wall of the microwave oven interior adjacent two opposing side walls 18. The telescoping track mechanisms comprise hollow, elongated and substantially rectangular outer track members 12 each having four sides. An end of each outer track member has a substantially rectangular open end 19. The outer track members 12 are mounted to the microwave interior with the two open ends facing the microwave oven door opening 2. On a side of the outer track members 12 are a plurality of apertures 6 for receiving suction cups 7 therein. The suction cups 7 each have a protrusion 20 extending from a distal end selectively insertable into the apertures. The suction cups 7 allow the track members to be removably attached to the microwave oven bottom wall 17.

Telescopingly and slidably received within the open ends of each outer track member are substantially rectangular inner track members 14. The inner track members 14 move longitudinally and axially with respect to the outer track members 12 to provide a telescoping track assembly. The device also comprises a substantially rectangular, planar shelf member 9 having four peripheral edges, an upper surface and a lower surface. Preferably the shelf member 9 is constructed with a heat resistant material. Attached to two opposing edges of the shelf member 9 are a pair of downwardly depending three sided channels 10 for surrounding and slidably engaging the track members 12. An end of each channel is attached to an end of a corresponding inner track member that protrudes through the open end of a corresponding outer track member. As the shelf member is horizontally withdrawn from the cooking chamber, the attached inner track members 14 slide horizontally out of the outer track members 12 while the channels 10 slide along the exterior thereof.

On the upper surface of the shelf member 9 is a vertically extending telescoping brace component 11. Preferably, the brace component 11 is proximal two converging edges of the shelf member 9 which are immediately adjacent the microwave side and rear walls when the shelf is completely inserted therein. The brace component 11 comprises at least one outer hollow tubular member 21 vertically attached to the upper surface of shelf member 9 received within which is one or more inner tubular telescoping members 22. When the assembly is being used, the telescoping brace 11 component is extended vertically until nearly engaging the top wall 16 of the microwave oven. Therefore, whenever the microwave shelf is retracted from the microwave oven interior, the telescoping brace 11 will engage the vertically depending portion 4 of the microwave door opening thereby preventing the shelf channels 10 and inner track members 14 from completely disengaging the outer track members 12.

The shelf member 9 also has a recessed area proximal an edge thereof which defines an integral handle 13. On an edge of the shelf member, preferably the same edge as the recessed handle 13, is a horizontally extending telescoping handle 15 which may be used when the recessed handle 13 is obstructed by hot foods, too hot to touch or is otherwise inaccessible.

To use the above described device, an outer track member 12 having the suction cups 7 thereon is attached to the bottom wall 17 of a microwave oven adjacent a side wall 18 by depressing the suction cups until they tightly grip the bottom wall. The other outer track member 12 is similarly attached adjacent an opposing sidewall. The shelf channels 10 are placed over the outer track members 12 and are attached to the inner track members 14 using any suitable attachment means. The telescoping brace 11 is extended vertically to a desired height. Then, the shelf may be moved along a horizontal path as desired into and out of the oven interior.

From the above description it is now apparent that the present invention provides a retractable microwave oven shelf which may be quickly and easily attached to a microwave oven interior. Although, there has been shown and described the preferred embodiment of the present invention, it is understood by those skilled in the art that the invention is not limited by the details of construction and arrangement of parts described above. Therefore, the invention is to be interpreted and limited in conjunction with the appended claims.

What is claimed is:

1. In combination with a microwave oven including a cooking chamber having top and bottom walls, two side walls and a rear wall, a retractable shelf assembly comprising:

a pair of outer track members, each having an open end and each attached to the bottom interior wall of the microwave oven cooking chamber, each adjacent a side wall thereof;

an inner track member telescopingly received within each of said outer track members and protruding from the open end thereof;

a substantially square shelf member having four peripheral edges, an upper surface and a lower surface;

a longitudinal, downwardly depending channel attached to each of two opposing peripheral edges of said shelf member, said shelf member having front and rear ends, the front end attached to a designated inner track member, said channel receiving said outer track member and slidable on allowing said shelf member to be horizontally extended a predetermined distance from and retracted within said cooking chamber.

2. A retractable shelf assembly according to claim 1 further comprising means for removably attaching said outer track members to the bottom wall of the microwave oven cooking chamber.

3. A retractable shelf assembly according to claim 2 wherein said means for removably attaching the outer track member to the bottom wall of the microwave comprises:

a plurality of apertures on a side of said outer track members;

a plurality of suction cups for selectively gripping a wall of the microwave oven interior each suction cup having a protrusion on a distal end, each protrusion removably received within said apertures.

4. A retractable shelf assembly according to claim 1 further comprising means for limiting said predetermined distance.

5. A retractable shelf assembly according to claim 4 therein said means for limiting the horizontal extension of said shelf member comprise a telescoping brace member horizontally extending from the upper surface of said shelf member.

6. A retractable shelf assembly according to claim 1 wherein said shelf member further comprises a recessed area defining an integral handle.

7. A retractable shelf according to claim 1 wherein said shelf member further comprises a telescoping handle horizontally extending from an edge thereof.

8. In combination with a microwave oven including a cooking chamber having a plurality of walls, a retractable shelf assembly comprising:

a support frame mounted to a wall of said cooking chamber, said support frame horizontally extendable a predetermined distance from and retractable within said cooking chamber;

a substantially rectangular shelf member having four peripheral edges and an upper and a lower surface, said shelf member mounted to said support frame;

a telescoping brace member vertically extending from the upper surface of said shelf member for limiting said predetermined distance.

9. A retractable shelf assembly according to claim 8 further comprising means for removably attaching said support frame to said wall.

10. A retractable shelf assembly according to claim 9 wherein said means for removably attaching said support frame to said wall comprises:

a plurality of apertures on a side of said support frame;

a plurality of suction cups, each having a cupped end for selectively gripping an interior wall and an opposite end;

a protrusion on said opposite end of each suction cup, said protrusion removably received within a select aperture.

11. A retractable shelf assembly according to claim 8 wherein said shelf member further comprises a recessed area defining an integral handle.

12. A retractable shelf assembly according to claim 8 wherein said shelf member further comprises a telescoping handle horizontally extending from an edge thereof.

13. In combination with a microwave oven including a cooking chamber having a plurality of interior walls, a retractable shelf assembly comprising:

a support frame mounted to an interior wall of said cooking chamber, said support frame horizontally extendable a predetermined distance from and retractable within said cooking chamber, said frame having a plurality of apertures on a side thereof;

a substantially rectangular shelf member having four peripheral edges, an upper surface and a lower surface, said shelf member mounted to said support frame;

a plurality of suction cups, each suction cup having a cupped end for selectively gripping an interior wall of said cook chamber and an opposite end;

a protrusion on said opposite end of each suction cup, each protrusion removably received within a select aperture for removably attaching said support frame to an interior wall of the cooking chamber.

14. A retractable shelf assembly according to claim 13 further comprising means for limiting said predetermined distance.

15. A retractable shelf assembly according to claim 14 wherein said means for limiting said predetermined distance comprises:

a telescoping brace vertically extending from the upper surface of said shelf member.

16. A retractable shelf assembly according to claim 13 wherein said shelf member further comprises a recessed area defining an integral handle.

17. A retractable shelf assembly according to claim 13 wherein said shelf member further comprises a telescoping handle horizontally extending from an edge thereof.

* * * * *